US011236607B2

(12) United States Patent
Tubel

(10) Patent No.: US 11,236,607 B2
(45) Date of Patent: Feb. 1, 2022

(54) REAL TIME DOWNHOLE PRESSURE AND TEMPERATURE SENSOR FOR RETROFITTING INTO PRODUCING WELLS

(71) Applicant: Tubel Energy LLC, The Woodlands, TX (US)

(72) Inventor: Paulo Tubel, The Woodlands, TX (US)

(73) Assignee: Tubel LLC, The Woodlands, TX (US)

( * ) Notice: Subject to any disclaimer, the term of this patent is extended or adjusted under 35 U.S.C. 154(b) by 1 day.

(21) Appl. No.: 16/747,610

(22) Filed: Jan. 21, 2020

(65) Prior Publication Data

US 2020/0232319 A1 Jul. 23, 2020

Related U.S. Application Data

(60) Provisional application No. 62/795,487, filed on Jan. 22, 2019.

(51) Int. Cl.
*E21B 47/16* (2006.01)
*E21B 47/18* (2012.01)
*E21B 47/00* (2012.01)

(52) U.S. Cl.
CPC ..... *E21B 47/16* (2013.01); *E21B 47/18* (2013.01)

(58) Field of Classification Search
None
See application file for complete search history.

(56) References Cited

U.S. PATENT DOCUMENTS

| | | | | |
|---|---|---|---|---|
| 7,573,397 | B2 * | 8/2009 | Petrovic | H01B 17/20 340/854.6 |
| 2003/0151977 | A1 * | 8/2003 | Shah | E21B 47/13 367/82 |
| 2016/0238720 | A1 * | 8/2016 | Gao | G01V 11/002 |
| 2019/0204467 | A1 * | 7/2019 | Curt | E21B 47/13 |
| 2020/0256184 | A1 * | 8/2020 | Pelletier | E21B 47/12 |
| 2020/0325769 | A1 * | 10/2020 | Van Zelm | E21B 47/14 |

* cited by examiner

*Primary Examiner* — Srilakshmi K Kumar
*Assistant Examiner* — Jerold B Murphy
(74) *Attorney, Agent, or Firm* — Maze IP Law, P.C.

(57) ABSTRACT

A system that can be deployed through production tubing in existing wells aid in eliminating the necessity to remove tubing from the well to install a gauge on the outside the production tubing or as part of the tubing string. The system comprises a hybrid tool which comprises a gauge system capable of being deployed through tubing to a pre-determined depth in the well. The gauge system comprises one or more wireless gauges to provide real time data from downhole to a surface location where the data are transferred to the surface using acoustic pressure travelling through production pipe and/or pressure pulses travelling through the produced fluid to the surface.

19 Claims, 4 Drawing Sheets

REAL TIME DOWNHOLE PRESSURE AND TEMPERATURE SENSOR FOR RETROFITTING INTO PRODUCING WELLS

RELATION TO OTHER APPLICATIONS

This application claims priority through U.S. Provisional Application 62/795,487 filed on Jan. 22, 2019.

BACKGROUND

Exploration and production companies operate several thousand producing oil and/or gas wells (on-shore, off-shore, sub-sea, both natural flowing and artificial lift equipped wells). Most of these wells, especially in mature assets, are not equipped with a permanent downhole pressure and/or temperature monitoring sensor. There is a need for suitable instrumentation that can be retrofitted in these existing wells, suitable for long term downhole measurement and preferably able to transmit wirelessly the data to the surface wellhead. Being able to continuously monitor these wells allows for a better understanding of the reservoir's behavior and enable suitable actions to improve reservoir management and production performances.

The control and monitoring of wells has become essential for the optimization of the production and the reduction of interventions in wells. The optimization of the production and reduction of the produced water are critical areas for economic success in offshore wells. As new processes for drilling, completion, production and reservoir management are developed, advancements in technologies related to temperature, pressure, and flow monitoring and downhole device control are required. Reservoir development systems must be constantly monitored to ensure maximum production.

Permanent downhole systems may only be modified, reconfigured or serviced by pulling the entire downhole apparatus out of the wellbore. It is laborious, time-consuming and expensive to pull the entire length of production tubing out of the casing to service and re-install a downhole control system.

FIGURES

Various figures are included herein which illustrate aspects of embodiments of the disclosed inventions.

DESCRIPTION OF EXEMPLARY EMBODIMENTS

Sensor technology as described herein used in conjunction with real time data communications techniques can provide on-demand access to the information necessary to optimize hydrocarbon production levels and achieve costs goals. Surface and downhole sensors may be used to change the way hydrocarbons are produced by optimizing production from downhole, supporting and extending the life of artificial lift systems and providing information used to update reservoir and production models.

The claimed invention comprises combining sensors with wireless telemetry to help provide operators with new versatility and capability to place sensors in areas of the wellbore that were prohibitive due to technical difficulties and/or economic justification. Downhole data acquisition systems can also be used to interface with surface control systems utilizing both wireless and cable transmission media. Wireless acoustic signals containing pressure and temperature information can be transmitted from downhole to the surface using a tubing string, such as production pipe or coiled tubing to the surface. Pressure pulses generated downhole such as by chocking a portion of the flow can also be used to transmit digital data to the surface. Electromagnetic energy can be used as the transmission energy using the geological formation or the production tubing as the medium of communications.

In addition, the ability to deploy gauges in existing wells to communicate in and out of the wellbore using through tubing wireless systems can increase the reliability of the production system and eliminate the requirements to remove the completion hardware from the wellbore. The optional elimination of cables, clamps, external pressure and temperature sensors, as well as splices on the cable that can fail inside the wellbore provides a significant advantage over existing gauge technologies. The wireless wellbore digital data communications and sensing system provides the capability to communicate through the production tubing using stress waves to transmit and receive digital data and commands inside the wellbore. The ability to transmit through the fluid as well during production by chocking a small portion of the fluid (pulser) allows for the creation of a pressure pulses that are detected at the surface.

Figure 1:
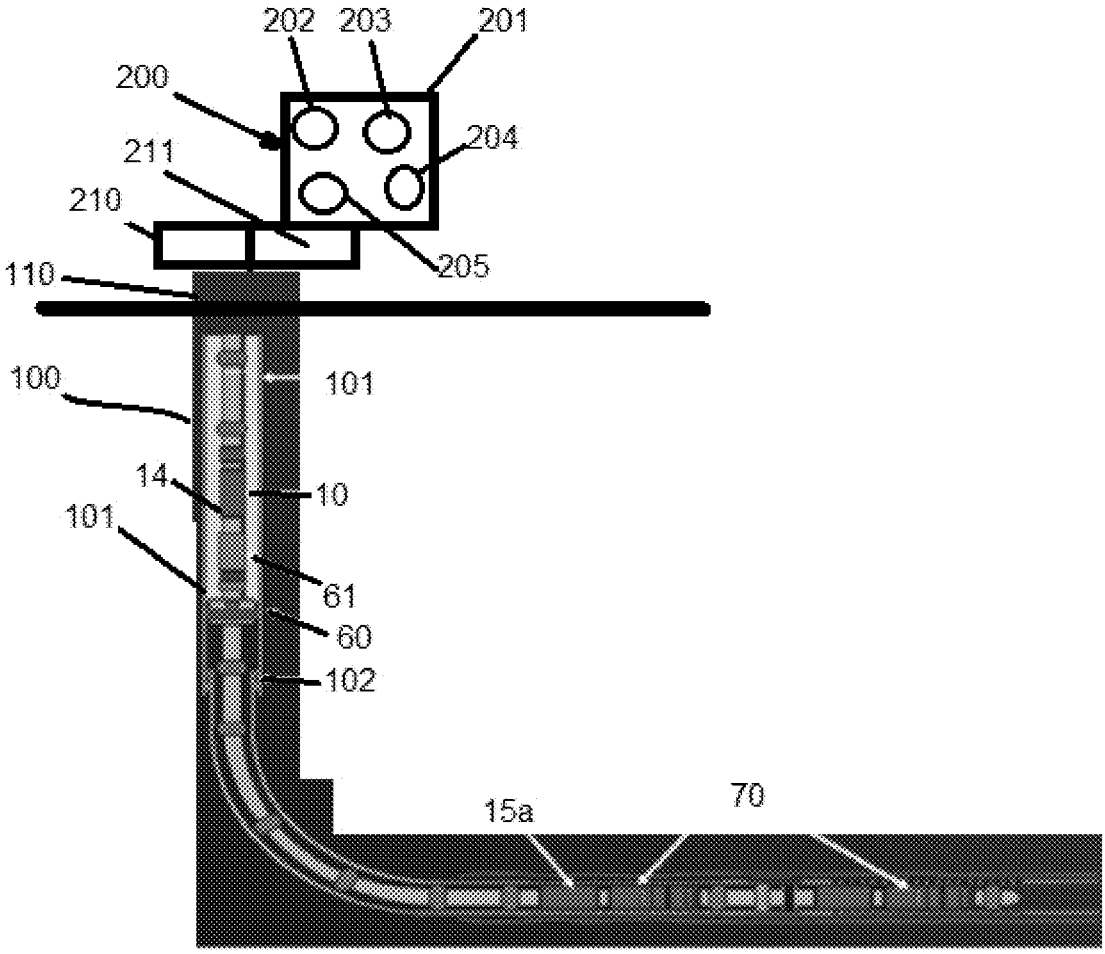
FIG. 1 is a schematic view of an exemplary system.

Referring to FIG. 1, real time, through tubing wireless gauge system 1, useful for deployment of downhole gauges in existing producing wells, comprises one or more hybrid tools 10 and one or more surface systems 200 located remotely from hybrid tool 10 proximate surface location 110. Surface system 200 may be a permanently deployed surface system.

Figure 2:
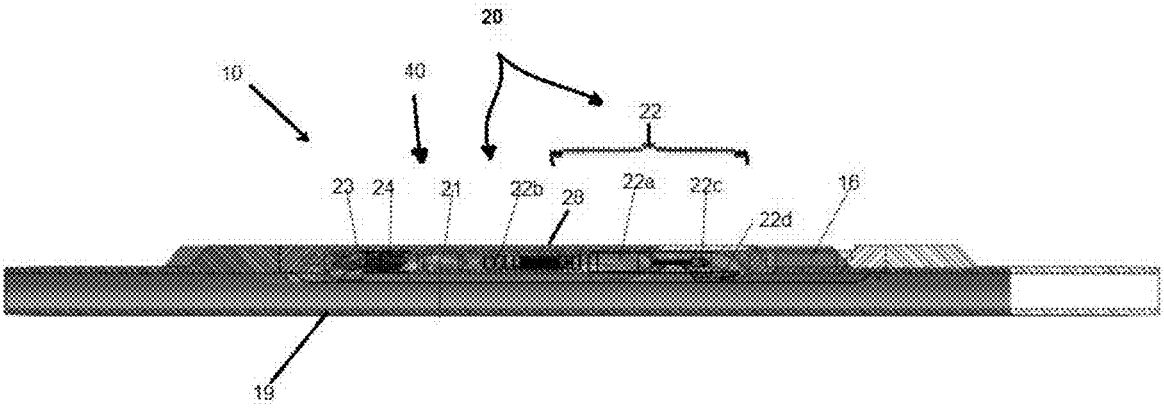
FIG. 2 is a cross-sectional view of an exemplary power and pulse generator.

Referring additionally to FIG. 2, in a first embodiment, hybrid tool 10 comprises one or more pressure pulse generators 22 adapted to generate pressure pulses representing digital data downhole when production fluid is present in well 100 (FIG. 1), where well 100 is typically a hydrocarbon well that is being produced, and to transmit the digital data as pressure pulses through the production fluid to transmit the digital data to surface location 110. Typically, this pressure pulse generation occurs when production fluid is present in well 100 that is being produced.

In this first embodiment, hybrid tool 10 comprises mandrel housing 19 containing various components such as sensors 14, electronics module 16, power store 42 which may comprise one or more backup batteries, downhole tool power generator 40, pressure pulse generator 22, acoustic generator 21, and an interface between one or more gauges and production tubing 101 (FIG. 1).

Figure 3:
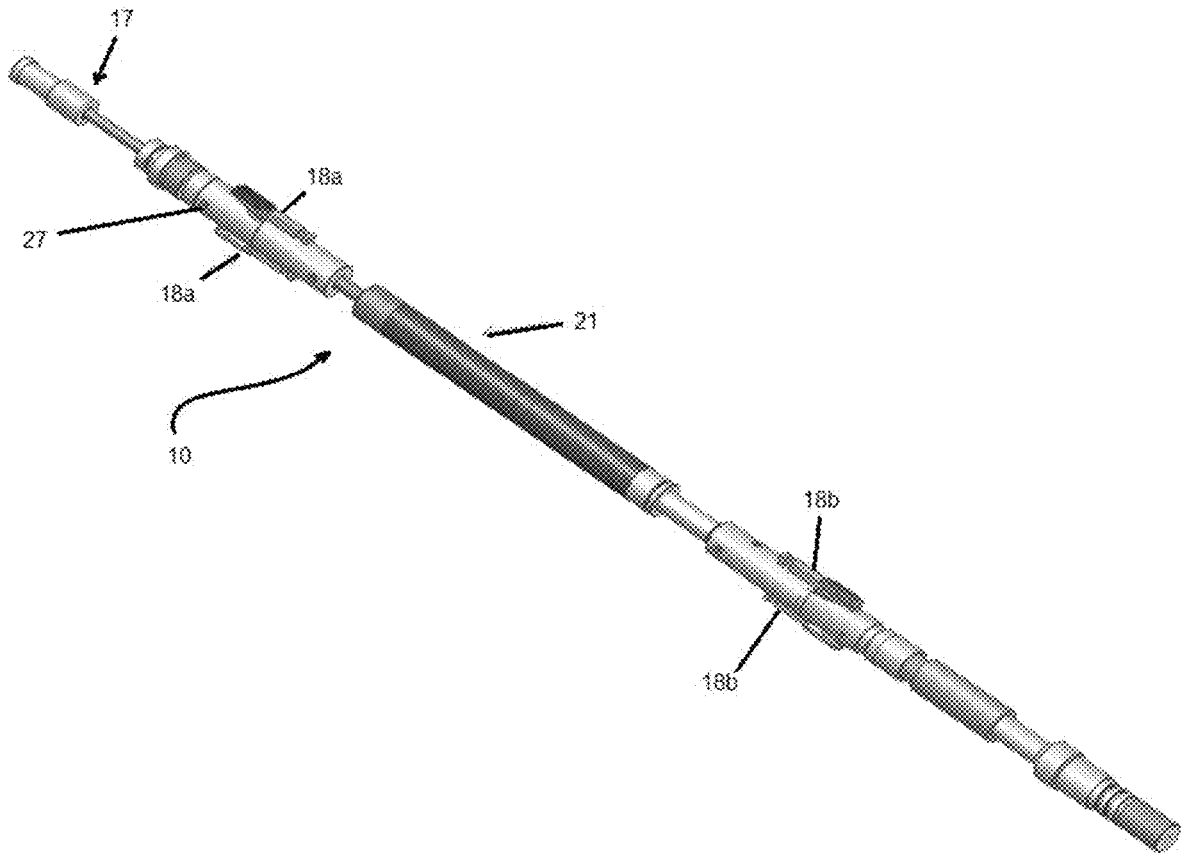
FIG. 3 is a view in partial perspective of an exemplary hybrid tool.

As illustrated in FIG. 3, hybrid tool 10 typically uses one or more slips (generally referred to as callout "18") to hold hybrid tool 10 in place inside well 100 (FIG. 1) by securing hybrid tool 10 against production tubing 101. Upper slips 18*a* prevent hybrid tool 10 from moving downwards while slips 18*b* prevent hybrid tool 10 from moving upwards. Slips 18 may also function to couple acoustic signals from hybrid tool 10 to production tubing 101. Slips 18 are typically held in place by springs (not specifically called out in the figures) located inside mandrel housing 19 (FIG. 2) that are compressed when a setting tool (not shown) pulls an upper end cap of hybrid tool 10 while pushing fishing neck 17. Set screws located in sleeve 28 may be sheared by the setting forces allowing slips 18 to be released from hybrid tool 10. Motor 29 (FIG. 4) can also be used to set slips 18 against the casing of the well.

Hybrid tool 10 further typically comprises wireless wellbore digital data transceiver 30 which is adapted to be disposed within a wellbore of well 100 and further adapted to transmit and receive digital data wirelessly using acoustic compressional waves transmitted though production tubing 101 when a triggering event occurs such as when production pressure of the production fluid drops below a predetermined pressure that prevents use of the digital data pressure pulses, when the well is shut in, when the production fluid does not fill the entire well, or if the conditions in the well prevent fluid pressure from reaching the surface, or the like, or a combination thereof.

Acoustic transmissions may have a transmission range between 6,000 ft and 7,500 feet without a repeater. Pressure pulses may travel in excess of 10,000 ft without a repeater.

Figure 4:
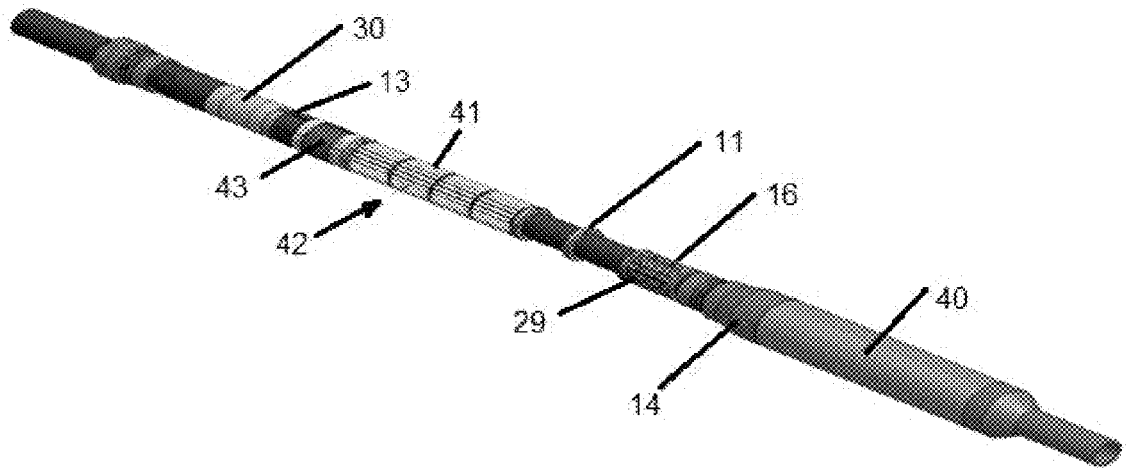
FIG. 4 is a view in partial perspective of an interior of an exemplary hybrid tool.

In the first embodiment, referring additionally to FIG. 4, hybrid tool 10 typically further comprises computer 13 which is operatively in communication with wireless wellbore digital data transceiver 30 and pressure pulse generator 22; one or more sensors 14 operatively in communication with computer 13; gauge system 15 operatively in communication with computer 13; and downhole tool power generator 16 operatively in communication with, and configured to provide to operate, wireless wellbore digital data transceiver 30, pressure pulse generator 22, sensors 14, computer 13, and/or gauge system 15.

Gauge system 15 typically comprises one or more wireless gauges such as wireless gauge 15*a* and may be sized smaller than an inside diameter of production pipe 101, e.g. less than around 2 inches, to allow production fluids to flow through production pipe 101 even after wireless gauge 15*a* is installed. Wireless gauge 15*a* will typically be of a length sufficient to accomplish its measurements, e.g. about 12 feet long.

Sensors 14, which may comprise a pressure sensor, a temperature sensor, or the like, or a combination thereof, may be quartz sensors stable over time with little to no drift or a maximum drift 0.1° C./year and +/−2 psi/year. If present, sensor 14 is typically located at the bottom of hybrid tool 10, typically within mandrel housing 19 (FIG. 2), and configured collect digital information on pressure and/or temperature. The accuracy of sensor 14 is typically approximately around 0.01 percent of full scale and a resolution of better than 0.1 psi. The long-term drift will be less than 2 psi per year.

Electronics module 16 comprises components sufficient to provide data acquisition and to also allow control of acoustic communications and pressure pulse transmissions. Electronics module 16 typically comprises one or more microcontrollers for data collection and creation of proper communications transmission timing as well as non-volatile memory for storage of gathered data. It can also determine if the data to be transmitted to surface location 110 is to be done via pressure pulses or acoustic communications. Electronics module 16 may also manage the power in wireless gauge 15*a*. Accelerometer or strain gauge 11 will be used to pick up information transmitted from the surface for 2-way communications.

Communications module 20 comprises acoustic generator 21 and pressure pulse generator 22. The acoustic waves generated by wireless gauge 15*a* travel up production pipe 101 to surface location 110 in a compression mode, minimizing losses related to fluid coupling and tubing threads. The data are detected at surface location 110 such as by using accelerometers or hydrophones. The pressure pulses travel to surface location 110 using the fluid in well 100. A small portion of the fluid being produced will be diverted and chocked by pressure pulser valve 22*a* to generate a pressure pulse that travels through the fluid to surface location 110. A pressure gauge at the surface detects the pressure pulses and converts them into electrical signals.

In embodiments, pressure pulse generator 22 is configured to transmit digital data through the fluid by choking a small portion of production fluid to create of a pressure pulses that are detected at surface location 110. Pressure pulse generator 22 acts by diverting a small portion of the production fluid through one or more pressure pulser valves 22*a* that open and close to modulate the flow of fluid going to surface location 110. This modulation causes a variation of pressure that can be picked up by the surface data converter. The communication typically uses a Non-Return-to-Zero technique to reduce the number of bits transmitted to the surface reducing the wear on pressure pulser valves 22*a*. Pressure pulse generator 22 typically comprises a ceramic material.

Wireless wellbore digital data transceiver 30, which can be an acoustic telemetry tool, transmits vibration frequencies that are unaffected by pump noise or other noise in well 100. Acoustic data are generally transmitted using a broadband multi-frequency signal to account for variances in the acoustic impedance of production tubing 101. As an example, piezo wafers may be used to generate an acoustic signal that are unique and address passbands available in production tubing 101. Passbands are characteristics of a production tubing string which allows for certain inherent frequencies to travel through production tubing 101 with minimal attenuation. A method to reduce the complexity and cost of the downhole gauges is to use a broadband acoustic signal that is composed of most of the frequencies that are normally associated with the efficient data transmission at the pipe diameter.

Figure 5:
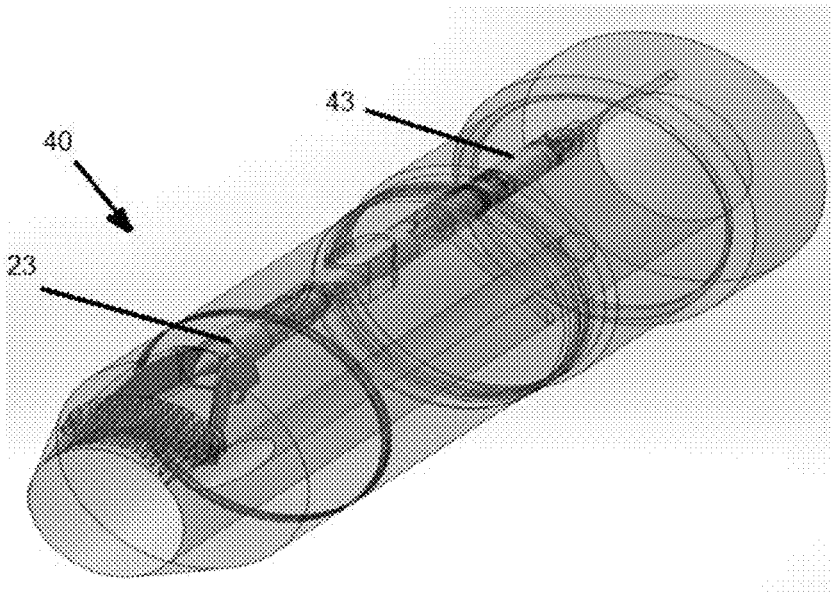
FIG. 5 is a see-through view in partial perspective of an interior of an exemplary hybrid tool illustrating power generation.

Referring additionally to FIG. 5, downhole power generator 40 is typically present to provide the required power for one or more wireless gauges, e.g. 15*a* (FIG. 1), to allow them to function for extended periods of time minimizing interventions to replace gauge batteries 41 (FIG. 4) and minimizing the maintenance costs of downhole gauges 15*a*. In embodiments, downhole power generator 40 comprises a plurality of downhole power generators 40, one for each gauge 15*a* of the plurality of gauges 15*a*. Downhole power generator 40 typically comprises impeller 23, electrical generator 21, and electronics module 43 adapted to condition the power to eliminate noise. Downhole power generator 40 will typically be able to provide 40 Watts of power rotating at 2,000 rpm which is very slow allowing for a long life of the downhole power generator. The AC power is converted into a DC power and conditioned to power the electronics and sensors. The power is stored in power store 42, which may comprise rechargeable batteries or super capacitors. The generator will be 0.7 inches in diameter by 15 inches long.

Referring back to FIG. 1, surface converter 210 collects acoustic energy on production tubing 101 at surface location 110 and converts it into electrical pulses. Surface converter 210 may be placed outside of well 100 or below tubing hanger 102 depending on whether or not an acoustic booster is mounted below tubing hanger 102. Surface converter 210 typically comprises an accelerometer mounted in contact with production tubing 101 which detects the acoustic waves and converts them into electrical pulses.

When present, the pressure pulses transmitted from downhole are detected using pressure sensor 211 at the surface in contact with the wellbore fluid and converted into electrical signals that are processed into representative data, e.g. data reflecting pressure and temperature, at the surface by surface system 200.

Data processor 201 collects the data transmitted from downhole using acoustic and/or pressure pulses and process the information into pressure and temperature data. The data is typically stored in high density memory, e.g. one associated with surface system 200, to provide a history of the data collection and well production. The data may also be sent to a remote location for further processing.

Data processor 201 typically comprises one or more data transceivers 202 remotely located with respect to hybrid tool 10 and adapted to wirelessly interchange digital data with wireless wellbore digital data transceiver 30 using the acoustic compressional waves and/or with pressure pulse generators 22 using pressure pulses; one or more data signal detection modules 203; one or more data transmission receivers 204, which can be data transmission transceivers; and software control and data acquisition (SCADA) system 205 configured for data acquisition and processing.

In embodiments, surface system 200 comprises one or more data processors and may use the Internet of Things to collect and transfer data and may be housed in an explosion proof box. Typically, the data processing for acoustic communications uses fast Fourier transform techniques to extract the data from any noise in well 100.

Figure 6:
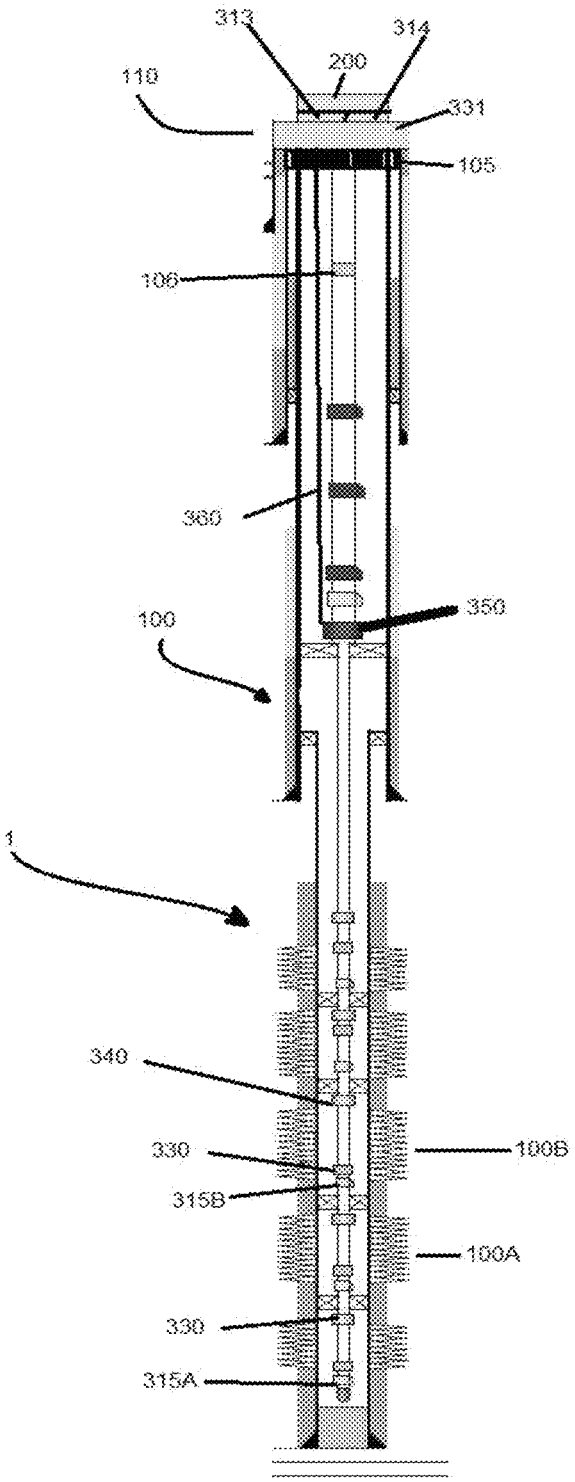
FIG. 6 is a schematic view of a further exemplary system.

In further embodiments, referring to FIG. 6, through tubing multizone monitoring system 1 comprises one or more hybrid tools 10 (FIG. 1) as described above. In these embodiments, one or more wireless wellbore digital data transceivers 330 (substantially similar to wireless wellbore digital data transceiver 30 and/or pressure pulse generators 22) are typically disposed within well 100 and adapted to transmit a digital data signal wirelessly, such as by using pressure pulses transmitted through a predetermined medium, and gauge system 315 (one or more individual gauges 315A, 315B substantially similar to gauge system 15) operatively in communication with wireless wellbore digital data transceiver 330. In any embodiment, the predetermined medium may comprise production fluid in well 100.

In addition, power generator 340 (which is similar to power generator 40) is operatively in communication with gauge system 315 and wireless wellbore digital data transceiver 330, where power generator 340 is operative to supply electrical power to gauge system 315 and wireless wellbore digital data transceiver 330.

As used herein, gauge system 315 comprises one or more individual gauges (basically referred to herein as gauge 315A or 315B) which may comprise a pressure gauge, a temperature gauge, or the like, or a combination thereof. Gauge system 315 typically comprises a plurality of gauges such as first gauge 315A disposed in first zone 100A within well 100 and second gauge 315B disposed in second zone 100B within well 100, second zone 100B being intermediate first zone 100A and surface location 110. Second gauge 315B may be further configured as data repeater to aid in transmitting the digital data signal to surface location 110. Each gauge 315A, 315B comprises a data transmitter configured to allow data transmission up to a maximum data communications distance and gauges 315A 315B are deployed at a distance between each pair of gauges 315 which is within the smaller of the maximum data communications distance those two gauges 315A, 315B. In embodiments, multiple gauges 315A, 315B are deployed within well 100, each gauge 315A, 315B being deployed within the maximum communication distance between that gauge 315A and an adjacent gauge 315B.

Typically, gauges 15*a*, 315A, 315B comprise an initial accuracy of ±3 psi for pressure and ±0.5° C. for temperature readings. In addition, gauge system 315 may be disposed in mandrel housing 319 (not specifically called out in the drawings but similar to mandrel housing 19). Material like 13 Cr will be used due to its strength and resistance to the downhole environment. Mandrel housing 319 is typically smaller than 2 inches in diameter for deployment in well 100. Slips 318 (not specifically called out in the drawings but similar to slips 18) are typically present as well.

In these embodiments, surface system 200 is typically present and is as described above.

In most embodiments, pressure pulses typically comprise fluid pressure pulses and wireless wellbore digital data transceiver 30 (FIG. 1) or 330 (FIG. 6) may comprise fluid pressure pulse generator 22 (FIG. 2), 322 (FIG. 6) configured to create a digital data signal for communications from downhole to surface location 110. As described above, in certain embodiments, the pressure pulses comprise acoustic pressure pulses and wireless wellbore digital data transceiver 30, 330 comprises an acoustic generator to create the data signal using acoustic pressure pulse digital data signals for communications from downhole to surface location 110.

In contemplated embodiments, slips 18 may act as a coupler and operatively be in communication with production tubing 101 to create a path for acoustic pressure pulse digital data signals from a predetermined gauge of gauge system 315 to production tubing 101.

Detector sub 350, which typically comprises an electronics module and/or gauge or the like, may be located inside well 100 and adapted to pick up the transmitted digital data signal; and cable 360, which may be a data transmission cable, may be present as well and operatively in communication with surface location 110 and detector sub 350. Detector sub 350 is typically disposed in well 100 proximate a location below tubing hanger 105 to convert the acoustic signals into electrical data and/or to increase the digital data signal interface with cable 350 to get the data to surface location 110 where it can be picked up at surface location 110 without using a data transmission cable.

Surface system 200 further comprises a digital signal processor adapted to reduce noise in the received digital data signal and extract the digital data signal from noise present in the predetermined medium. In embodiments, surface system 200 typically further comprises an external data transceiver adapted to interface surface system 200 to a system located remotely from surface system 200. In embodiments, surface system 200 is adapted to use a ModBus or an Internet of Things protocol when interfacing with a data processing system located remotely from surface system 200.

In certain embodiments, near surface relay 106 may be present and typically disposed within well 100. Near surface relay 106 is adapted to obtain a transmitted digital data signal from downhole and amplify the transmitted digital data signal so that the transmitted digital data signal can go through tubing hanger 105 and a wellhead to eliminate the need to put a detector in well 100.

In the operation of exemplary methods, referring back to FIG. 1 and FIG. 6, real time through tubing wireless gauge system 1 can be used for deployment of downhole gauges in existing producing wells without the need to pull the production tubing from the well. System 1 can be used to provide information from inside the wellbore that is transmitted at intervals determined by the customer and programmed before each hybrid tool 10 is inserted in well 100.

In embodiments, data will be transmitted wirelessly using acoustic compressional waves transmitted though production tubing 101 and/or pressure pulses generated by pressure pulse generator 22 downhole and transmitted through the production fluid. A downhole environment may not homogeneous and therefore may require different approaches for different wells and for different stages of production. As an example, pressure pulses can be used when the well is being produced to transmit data to the surface. Acoustic energy can be used as the mean for communications when the production pressure drops significantly or when the well is shut in.

Data may be obtained in real time without the need to pull production tubing 101 from well 100 using real time through tubing wireless gauge system 1, 3, described above. First gauge 315A may be deployed at a first location within the well proximate first zone 100A within well 100 and second gauge 315B deployed proximate second zone 100B within well 100 at a second location, e.g. one distal from the first location within well 100 intermediate first zone 100A and surface location 101. Gauge system 315 may be installed downhole at relatively low cost because hybrid tool 10 may be lowered in well 100 through the inside of production tubing 101. Accordingly, there may be no need to pull production tubing 101 from well 100 to install a new gauge. In embodiments, gauge system 315 may be deployed in well 100 using a slickline if well 100 is vertical or has a low deviation from vertical. Slips 18 may be set against production tubing 101 like a packer slips to help assure that gauge system 315 is secured in its location in well 100. When gauge system 315 reaches a desired location within production pipe 101, an operator may set gauge system 315 in place by manipulating a setting tool and locking system gauge 315 in a "set" configuration such as by a ratchet spring.

Power supply 340 supplies electrical power to gauge system 315 and wireless wellbore digital data transceiver 330. Data obtained from gauge system 315 is converted into a digital data signal such as by wireless wellbore digital data transceiver 330 which is also used to wirelessly transmit a digital data signal comprising the data using pressure pulses and/or acoustic pressure transmitted through a predetermined medium such as production fluid and/or production pipe 110. A data signal detector, e.g. detector sub 350 or surface converter 210 and/or pressure sensor 211, may then be used to detect the transmitted digital data signal using the pressure pulses transmitted through the predetermined medium. The detected digital signal is then provided to the surface software control and data acquisition (SCADA) system 205 for data acquisition and processing.

As noted above, wireless wellbore digital data transceiver 330 may wirelessly transmit the digital data signal though the predetermined medium by using pressure pulse generator 22 configured to create the digital data signal for communications from downhole to the surface and/or transmit and receive digital data wirelessly using acoustic compressional waves transmitted though production tubing 101 when production pressure of the production fluid drops below a predetermined pressure that prevents use of the digital data pressure pulses or when well 100 is shut in.

In certain methods, one or more gauge systems 315 may act as a data transceiver and be disposed intermediate a further downhole wireless gauge system 315 deployed in well 100 and surface location 110 and used to boost and re-transmit data from wireless gauge system 315. Gauge systems 315 located intermediate surface location 110 and a most distally located gauge system 315 can also be downhole gauges where the data from a second gauge 15*a*, 315B disposed immediately below a first gauge 15*a*, 315A is combined with data from the second gauge 15*a*, 315B and transmitted to surface location 110. The same process can be repeated all the way to the surface.

Surface system 200 data transceiver 200 may comprise a pressure pulse generator or an acoustic generator and communicate with a wireless gauge of gauge system 315 through the predetermined medium.

As discussed herein, wireless wellbore digital data transceiver 330 may wirelessly transmit the digital data signal though the predetermined medium by using fluid pressure pulse generator 22 configured to create the digital data signal for communications from downhole to surface location 110 and/or transmit and receive digital data wirelessly using acoustic compressional waves transmitted though production tubing 101 when production pressure of the production fluid drops below a predetermined pressure that prevents use of the digital data pressure pulses or when the well is shut in.

Real-time data may be provided with a sample rate of 1 datum per minute. In addition, SCADA system 205 shall gather the data acquired downhole and store them in an internal memory which may be configured to guarantee multiple days of storage capacity.

When or if necessary, one or more gauges 15*a*, 315A, 315B of gauge system 315 can be retrieved from well 200 by releasing slips 18 from production pipe 101. Fishing neck 17, typically located on the top of gauge system 315 or hybrid tool 10, can be latched to a retrieval tool on a wireline, slickline, or an electric line allowing a surface unit to pull hybrid tool 10. Slips 18 may be released when shear screws 27 located on the lower section of hybrid tool 10 are ruptured.

The foregoing disclosure and description of the inventions are illustrative and explanatory. Various changes in the size, shape, and materials, as well as in the details of the illustrative construction and/or an illustrative method may be made without departing from the spirit of the invention.

The invention claimed is:

1. A real time, through tubing wireless gauge system for deployment of downhole gauges in a producing well, comprising:

a) a hybrid tool, comprising:

i) a housing adapted to be disposed within a wellbore of a well;

ii) a pressure pulse generator disposed in the housing and adapted to generate pressure pulses downhole when production fluid is present in the well that is being produced, the pressure pulses comprising digital data, and to transmit the pressure pulses comprising the digital data through the production fluid to a surface location;

iii) a wireless wellbore digital data transceiver adapted to be disposed within the wellbore of the well and to transmit and receive digital data wirelessly using acoustic compressional waves transmitted though production tubing if a triggering condition is reached, wherein the triggering condition comprises production pressure of the production fluid dropping below a predetermined pressure that prevents use of the digital data pressure pulses, shutting in of the well, failure of the production fluid to fill the entire well, or conditions in the well preventing fluid pressure from reaching the surface;

iv) an electronics module configured to acquire data, the electronics module operatively in communication with the wireless wellbore digital data transceiver and the pressure pulse generator, the electronics module comprising a computer;

v) a sensor operatively in communication with the electronics modules;

vi) a gauge system operatively in communication with the computer, the gauge system comprising a pressure gauge or a temperature gauge;

vii) a power store disposed in the housing and operatively in communication with, and configured to provide electrical power to operate, the electronics module, the wireless wellbore digital data transceiver, the pressure pulse generator, the sensor, the computer, and the gauge system; and viii) a downhole power generator operatively in communication with, and configured to provide electrical power to operate, the power store, the wireless wellbore digital data transceiver, the pressure pulse generator, the sensor, the computer, and the gauge system; and b) a data processor located remotely from the hybrid tool proximate a surface location, the data processor comprising:

i) a data transceiver adapted to wirelessly interchange digital data with the wireless wellbore digital data transceiver using the acoustic compressional waves or the pressure pulse generator using the pressure pulses;

ii) a software control and data acquisition (SCADA) system configured for data acquisition and processing, the SCADA system operatively in communication with the remotely located data transceiver;

iii) a data signal detection module in communication with the production fluid, the production tubing, and the SCADA system; and iv) a data receiver in communication with the production fluid, the production tubing, and the SCADA system.

2. The real time, through tubing wireless gauge system of claim 1, wherein b) the wireless wellbore digital data transceiver, computer, sensor, gauge system, and downhole power generator are disposed at least partially within the housing.

3. A through tubing multizone Monitoring system, comprising:

a) a wireless wellbore digital data transceiver adapted to be disposed within a wellbore of a well and further adapted to transmit a digital data signal wirelessly using pressure pulses transmitted through a predetermined medium;

b) a plurality of hybrid tools operatively in communication with the wireless wellbore digital data transceiver, the plurality of hybrid tools comprising:

i) a first hybrid tool adapted to be disposed in a first zone within the well, the first hybrid tool comprising:

(1) a housing adapted to be disposed within a wellbore of a well;

(2) a pressure pulse generator disposed in the housing and adapted to generate pressure pulses downhole when production fluid is present in the well that is being produced, the pressure pulses comprising digital data, and to transmit the pressure pulses comprising the digital data through the production fluid to a surface location;

(3) a wireless wellbore digital data transceiver adapted to be disposed within the wellbore of the well and to transmit and receive digital data wirelessly using acoustic compressional waves transmitted though production tubing if a triggering condition is reached, wherein the triggering condition comprises production pressure of the production fluid dropping below a predetermined pressure that prevents use of the digital data pressure pulses, shutting in of the well, failure of the production fluid to fill the entire well, or conditions in the well preventing fluid pressure from reaching the surface;

(4) an electronics module configured to acquire data, the electronics module operatively in communication with the wireless wellbore digital data transceiver and the pressure pulse generator, the electronics module comprising a computer;

(5) a sensor operatively in communication with the electronics module;

(6) a gauge system operatively in communication with the computer; and (7) a power store disposed in the housing and operatively in communication with, and configured to provide electrical power to operate, the electronics module, the wireless wellbore digital data transceiver, the pressure pulse generator, the sensor, the computer, and the gauge system; and ii) a second hybrid tool adapted to be disposed in a second zone within the well, the hybrid tool substantially identical to the first hybrid tool, the second zone intermediate the first zone and a surface location, the second hybrid tool further configured as data repeater to aid in transmitting the digital data signal generated by the first hybrid tool to the surface location;

c) a power generator disposed downhole in the well and operatively in communication with a predetermined subset of the plurality of hybrid tools, the power store, and the wireless wellbore digital data transceiver, the power supply operative to supply electrical power to the predetermined subset of the plurality of hybrid tools and the wireless wellbore digital data transceiver system; and d) a surface data system, comprising:

i) a software control and data acquisition (SCADA) system configured for data acquisition and processing;

ii) a data signal detection module in communication with the predetermined medium and the SCADA system; and iii) a data receiver adapted to wirelessly communicate with the wireless wellbore digital data receiver using the pressure pulses transmitted through the predetermined medium, the data receiver in communication with the predetermined medium and the SCADA system.

4. The through tubing multizone monitoring system of claim 3, further comprising a near surface relay disposed within the well and adapted to obtain a transmitted digital data signal from the wireless wellbore digital data transceiver and amplify the transmitted digital data signal so that the transmitted digital data signal can go through a tubing hanger and a wellhead to eliminate the need to put a detector in the well.

5. The through tubing multizone monitoring system of claim 3, wherein the gauge system comprises a pressure gauge or a temperature gauge.

6. The through tubing multizone monitoring system of claim 3, wherein:

a) the pressure pulses comprise fluid pressure pulses; and b) the wireless wellbore digital data transceiver comprises a fluid pressure pulse generator configured to create the digital data signal for communications from downhole to the surface via pressure pulses in a fluid present in the well.

7. The through tubing multizone monitoring system of claim 3, wherein:

a) the pressure pulses comprise acoustic pressure pulses; and b) the wireless wellbore digital data transceiver comprises an acoustic generator to create the data signal using acoustic pressure pulse digital data signals for communications from downhole to the surface location.

8. The through tubing multizone monitoring system of claim 7, further comprising a coupler operatively in communication with production tubing present in the well to create a path for the acoustic pressure pulses digital data signal from a predetermined gauge of the plurality of gauges to production tubing.

9. The through tubing multizone monitoring system of claim 3, wherein the predetermined medium comprises production fluid in the well or tubing.

10. The through tubing multizone monitoring system of claim 3, further comprising a detector sub located inside the wellbore and adapted to detect the transmitted digital data signal wherein the detector sub is disposed proximate a location below a tubing hanger to increase the digital data signal so that it can be detected at the surface without using a data transmission cable.

11. The through tubing multizone monitoring system of claim 3, further comprising:

a) a detector sub located inside the wellbore and adapted to detect the transmitted digital data signal; and b) a cable operatively in communication with the surface location and the detector sub, the cable operative to transmit a detected transmitted digital data signal electronically.

12. The through tubing multizone monitoring system of claim 3, wherein at least one of the downhole power generators comprises a battery or an impeller power generator.

13. The through tubing multizone monitoring system of claim 3, wherein:

a) the gauge system of a predetermined subset of the plurality of hybrid tools comprises a single gauge per each hybrid tool in the subset of the plurality of hybrid tools; and b) the downhole power generator comprises a plurality of downhole tool power generators, one downhole power generator for each hybrid tool of the subset of the plurality of hybrid tools which comprises a single gauge.

14. A method of obtaining data from an existing producing hydrocarbon well without the need to pull the production tubing from the well using a through tubing multizone monitoring system comprising a predetermined set of wireless wellbore digital data transceivers adapted to be disposed within the well and adapted to transmit a digital data signal wirelessly through a predetermined medium, a plurality of hybrid tools operatively in communication with the set of wireless wellbore digital data transceivers where the plurality of hybrid tools comprises a first hybrid tool adapted to be disposed in a first zone within the well and a second hybrid tool adapted to be disposed in a second zone within the well where the second zone is intermediate the first zone and a surface location and where the second hybrid tool is further configured as data repeater to aid in transmitting the digital data signal to the surface location, a power generator disposed downhole in the well and adapted to be operatively in communication with a predetermined subset of the plurality of hybrid tools and the set of wireless wellbore digital data transceivers which is operative to supply electrical power to the predetermined subset of the plurality of hybrid tools and the set of wireless wellbore digital data transceivers, and a surface data system comprising a data transceiver adapted to wirelessly communicate with the wireless wellbore digital data transceiver through the predetermined medium, a data signal detection module, a data receiver, and a surface software control and data acquisition (SCADA) box for data acquisition and processing, each hybrid tool comprising a housing adapted to be disposed within a wellbore of a well, a pressure pulse generator disposed in the housing and adapted to generate pressure pulses downhole when production fluid is present in the well that is being produced and to transmit the pressure pulses comprising the digital data through the production fluid to a surface location where the pressure pulses comprises digital data, a wireless wellbore digital data transceiver adapted to be disposed within the wellbore of the well and adapted to transmit and receive digital data wirelessly using acoustic compressional w ayes transmitted though production tubing if a triggering condition is reached, wherein the triggering condition comprises production pressure of the production fluid dropping below a predetermined pressure that prevents use of the digital data pressure pulses, shutting in of the well, failure of the production fluid to fill the entire well, or conditions in the well preventing fluid pressure from reaching the surface, an electronics module configured to acquire data where the electronics module is operatively in communication with the wireless wellbore digital data transceiver and the pressure pulse generator and the electronics module comprises a computer, a sensor operatively in communication with the electronics module, a gauge system operatively in communication with the computer, and a power store disposed in the housing and operatively in communication with and configured to provide electrical power to operate the electronics module, the wireless wellbore digital data transceiver, the pressure pulse generator, the sensor, the computer, and the gauge system, the method comprising:

a) deploying the first wireless hybrid tool of the plurality of hybrid tools at a first location within the well proximate a first zone within the well, the first wireless hybrid tool comprising a first maximum data communication distance by which it can be operatively in communication with a set of wireless wellbore digital data transceivers disposed within the well;

b) deploying the second wireless hybrid tool proximate a second zone within the well zone at a second location distal from the first location within the well intermediate the first zone and a surface location, the second hybrid tool configured to function as data repeater to aid in transmitting a digital data signal to the surface location, the second hybrid tool comprising a second maximum data communication distance, the second location being a distance within a smaller of the first maximum communications distance and the second maximum communications distance;

c) deploying the power generator downhole;

d) placing the power generator downhole operatively in communication with a predetermined subset of the plurality of hybrid tools and the set of wireless wellbore digital data transceivers;

e) using the power generator to supply electrical power to the plurality of hybrid tools and the set of wireless wellbore digital data transceivers;

f) converting data obtained from the plurality of hybrid tools into a digital data signal;

g) using a wireless wellbore digital data transceiver of the set of wireless wellbore digital data transceivers to wirelessly transmit a digital data signal comprising the data through the predetermined medium;

h) using a data signal detector to detect the transmitted digital data signal transmitted through the predetermined medium; and i) providing the detected digital signal to the surface software control and data acquisition (SCADA) system located proximate the surface location for data acquisition and processing.

15. The method of claim 14, wherein:

a) deploying the first hybrid tool at the first location within the well and deploying the second hybrid tool within the well comprises deploying multiple hybrid tools within the well, each hybrid tool of the multiple hybrid tool being deployed within the maximum communication distance between that hybrid tool and an adjacent hybrid tool, at least one intermediate hybrid tool configured to act as a data repeater; and b) using the intermediate hybrid tool to repeat data received from one of the lower hybrid tool and the upper hybrid tool to the other of the lower hybrid tool and the upper hybrid tool.

16. The method of claim 14, wherein the set of wireless wellbore digital data transceivers comprises a pressure pulse generator adapted to be disposed within a wellbore of the well, the method further comprising:

a) using the wellbore digital data transceiver comprising the pressure pulse generator of the set of wireless wellbore digital data transceivers to generate pressure pulses downhole when production fluid is present in the well that is being produced, the pressure pulses comprising digital data, by creating a set of fluid pressure pulses which comprise the digital data signal for communications from downhole to the surface; and b) using the wellbore digital data transceiver comprising the pressure pulse generator of the set of wireless wellbore digital data transceivers to transmit the pressure pulses comprising the digital data through the production fluid to the surface location though the predetermined medium.

17. The method of claim 14, wherein the set of wireless wellbore digital data transceivers comprises an acoustic wireless wellbore digital data transceiver, the method further comprising:

a) detecting a triggering condition; and b) using the wireless wellbore digital data transceiver that comprises the acoustic wireless wellbore digital data transceiver to transmit and receive digital data wirelessly using acoustic compressional waves transmitted though production tubing when the triggering condition is detected.

18. The method of claim 14, further comprising using a data transceiver disposed intermediate a wireless hybrid tool deployed in the well and the surface location to boost and re-transmit data from the wireless hybrid tool.

19. The method of claim 14, further comprising using an upper hybrid tool disposed above a lower hybrid tool to combine data from the lower hybrid tool with data from the upper hybrid tool, the combined data further transmitted to a surface location.

* * * * *